US007081706B2

(12) United States Patent
Huang et al.

(10) Patent No.: US 7,081,706 B2
(45) Date of Patent: Jul. 25, 2006

(54) PLASMA DISPLAY PANEL AND METHOD OF FORMING THE SAME

(75) Inventors: Wen-Rung Huang, Tainan (TW); Ching-Chung Cheng, Ping-Chen (TW); Yuan-Chi Lin, Tao-Yuan (TW); Yu-Wen Chen, Dou-Liu (TW)

(73) Assignee: Chungwa Picture Tubes, Ltd., Tapei (TW)

( * ) Notice: Subject to any disclaimer, the term of this patent is extended or adjusted under 35 U.S.C. 154(b) by 0 days.

(21) Appl. No.: 10/792,880

(22) Filed: Mar. 5, 2004

(65) Prior Publication Data

US 2004/0183440 A1 Sep. 23, 2004

(30) Foreign Application Priority Data

Mar. 7, 2003 (TW) ..... 92104970 A

(51) Int. Cl.
*H01J 17/49* (2006.01)

(52) U.S. Cl. ..... 313/583; 313/584

(58) Field of Classification Search ..... 313/582–587
See application file for complete search history.

(56) References Cited

U.S. PATENT DOCUMENTS 5,541,479 A 7/1996 Nagakubo
5,659,226 A * 8/1997 Shigeta ..... 313/491
5,742,122 A 4/1998 Amemiya et al.
6,097,149 A 8/2000 Miyaji et al.
6,362,799 B1 3/2002 Ueoka et al.
6,469,541 B1 10/2002 Tran et al.
6,522,072 B1 * 2/2003 Yura et al. ..... 313/582
6,531,819 B1 3/2003 Nakahara et al.
6,749,932 B1 6/2004 Gould
6,819,046 B1 * 11/2004 Hirano ..... 313/582
6,879,104 B1 * 4/2005 Tessier ..... 313/582
2001/0024921 A1 * 9/2001 Hirano ..... 445/24
2001/0054872 A1 * 12/2001 Okigawa et al. ..... 313/586
2002/0084752 A1 * 7/2002 Yoshioka et al. ..... 313/584

* cited by examiner

*Primary Examiner*—Joseph Williams
*Assistant Examiner*—Peter Macchiarolo
(74) *Attorney, Agent, or Firm*—Birch, Stewart, Kolasch and Birch, LLP

(57) ABSTRACT

A plasma display panel with a plurality of non-transparent display electrode pairs and a method of forming the same. Each electrode of every non-transparent display electrode pair is separated from but close to one another for effective discharging. For effective displaying, it is necessary that the area of the non-transparent display electrodes is smaller than the area of the panel. In the present invention, the shape of the non-transparent display electrodes are manufactured in a shape with a plurality of openings, such as a ladder or a chain.

24 Claims, 9 Drawing Sheets

PLASMA DISPLAY PANEL AND METHOD OF FORMING THE SAME

BACKGROUND OF THE INVENTION

1. Field of the Invention

The invention relates to a plasma display panel (PDP) and a method for forming the PDP. More particularly, this invention relates to a PDP with non-transparent display electrodes pairs and a method of using both the non-transparent material and the transparent material to form the non-transparent display electrodes pairs of the PDP.

2. Description of the Prior Art

The plasma display panel has been broadly applied in the contemporary electronic industry, due to the characteristics of high brightness, colorful screen, large visible angle and thin thickness of PDP. Therefore, an urgent requirement is how to further improve the structure and the forming method of the PDP.

As shown in FIG. 1A, the conventional structure of the PDP comprises at least the following: a front substrate 11, a rear substrate 12, a plurality of discharge electrodes 13, a plurality of trace electrodes 14, a plurality of black scripts 15, a plurality of data electrodes 16, dielectric layer 17 and phosphor layer 18. Moreover, as shown in FIG. 1B, each display electrodes pair located between neighboring black scripts is a combination of two separated display electrodes, wherein each display electrode has a discharge electrode 13 and a trace electrode 14. Herein, two display electrodes 13 are used to discharge (as a discharge cell) and two trace electrodes 14 are used to control the status of the display electrodes pair.

To further understand the prior arts of the conventional PDP, please refer to the following: U.S. Pat. No. 6,749,932, U.S. Pat. No. 6,469,541, U.S. Pat. No. 6,362,799 B1, U.S. Pat. No. 6,097,149, U.S. Pat. No. 5,742,122 and U.S. Pat. No. 5,541,479.

However, the quality of the conventional structure shown in FIG. 1A and FIG. 1B is usually limited by the following disadvantageous.

On the one hand, since the large area of discharge electrodes 13, such discharge electrodes 13 are usually made of the transparent conductive material, such as indium tin oxide (ITO) or lead tin oxide (LTO), to avoid the degradation of the aperture ratio of the PDP. Furthermore, since trace electrodes 14 are used to conduct signals, and are usually made of non-transparent conductive material with a high conductivity, the area of trace electrodes 14 are minimized to ensure the aperture ratio. Nonetheless, the resistance of the contemporary transparent conductive material is significantly higher than that of the non-transparent conductive material, such as black script, metal and amorphous silicon. Hence, during the discharge process between trace electrodes 14 and discharge electrodes 13, the total resistance of both the trace electrodes 14 and the discharge electrodes 13 is large enough to induce a large resistance-capacitance constant (RC constant). Therefore, the response rate of the PDP is limited by the delay effect induced by the large RC constant.

On the other hand, since the different resistance between the aforementioned electrodes, the current almost only flows through trace electrodes 14 except the following condition: the current flows through discharge electrodes 13 of one pixel while the data electrode 16 of said pixel is charged. Moreover, to prevent the reduction of the aperture ratio and to simplify the fabrication, the contour of each trace electrode 14 is usually a straight line. Therefore, if the fabrication of trace electrode 14 has an error or the operation of trace electrode 14 has problem, trace electrode 14 will break. Thus, the actual resistance of the current through different pixels is significantly increased (discharge electrode is used to conduct current), and then the display result of the PDP is degraded because of different pixels having different resistance.

Accordingly, the conventional PDP is significantly far away the perfection, especially the RC constant of the display electrodes pair corresponding to the data electrode, the aperture ratio and the broken electrode problem.

SUMMARY OF THE INVENTION

There is an object of the present invention to provide a plasma display panel, which effectively solves the aforementioned defects of the conventional PDP, with low resistance and high aperture ratio and a method for forming the present PDP. Moreover, the invention is present to improve the conventional defects, such as high RC constant induced by the co-existence of the transparent discharge electrode and the non-transparent trace electrode.

There is an another object of the present invention to only use the non-transparent conductive material with low resistance to form the electrodes pair corresponding to the data electrode. More especially, to form the required electrodes pairs without the necessary transparent conductive material such that any defect induced by the high resistance of the transparent conductive material is avoidable.

Furthermore, there is a further object of the present invention to modify the distribution of the non-transparent portion of the electrodes pair such that the shape of each non-transparent display electrodes pair is a two dimensional shape with some transparent openings, such as ladder shape, chain shape and/or network shape. Herein, the display electrodes correspond to both the conventional discharge electrodes and the conventional trace electrodes. Hence, the distance between two non-transparent display electrodes of the same electrodes pair could be equal to the distance between two transparent discharge electrodes of the same electrode, and then the degree of the discharge process could be the briefly equivalent. Hence, for each pixel, the area occupied by the non-transparent display electrodes of the same electrodes pair could be briefly equal to the area occupied by the conventional non-transparent trace electrodes, and then the aperture ratio could be briefly equivalent. Hence, owing to a two dimensional shape is a combination of numerous one dimensional shapes which means numerous current paths, the defects induced by severed non-transparent display electrodes, by errors in fabrication or by problems of operation, could be minimized for a dimensional shape, which can almost provide a substitute current path around the severed portion of the non-transparent display electrodes.

Some further characters of the present invention are the following: the non-transparent display electrode could be made of a transparent material and an overlaid non-transparent material; the non-transparent material could be made of only non-transparent material; two non-transparent display electrodes of the same electrodes pair could have different shape and material; and the details (such as shape/details/configuration etc) of each non-transparent electrode is adjustable.

To compare with the conventional technology, the present invention at least has the following effectiveness:

(1) The present invention uses the non-transparent display electrodes pair, and the resistance of the contemporary non-transparent conductive material is clearly smaller than the resistance of contemporary transparent conductive material. In contrast, the conventional electrodes pair has the transparent discharge electrode and the non-transparent track electrode.

Therefore, the present invention not only reduces the resistance of the current path through numerous pixels but also reduces the resistance of the current path through different electrodes for discharging (owing to no high resistance transparent conductive material is appeared). Further, the RC constant also is reduced and then the response rate of the PDP is improved.

(2) The present invention could keep the distance between two discharge electrodes briefly equal to the distance between two conventional discharge electrodes. Hence, the efficiency of the discharge process is not degraded.

Further, the present invention never limits the opposing sides of different display electrodes being parallel to each other as the conventional discharge electrodes. In contrast, the present invention allows the distance between different display electrodes being not a constant and the shape of each display electrode being not a straight line or plane. Therefore, the present invention could use the point discharge phenomena to improve the discharge process.

(3) The present invention allows the shape of each display electrode being a two-dimensional shape which provides numerous current paths, but the conventional PDP limits the shape of each electrode (especial the discharge electrode) to be a one dimensional shape which only proves single current paths.

Therefore, even the fabrication has error(s) or the operation has problem(s), the present invention almost uses another current path to replace the severed current path. Thus, the risk of severed portion(s) of display electrode is significantly decreased.

(4) The present invention uses the non-transparent display electrodes, and then the contrast of the PDP is further enhanced. Surely, to ensure the aperture ratio, the area of the non-transparent display electrodes must be properly adjusted.

However, because the present invention could limit the shape of each non-transparent display electrode being a two-dimensional shape with many transparent opening, the present invention always can improve the display quality of the PDP by distributing the non-transparent conductive material as numerous fragments.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 2A:
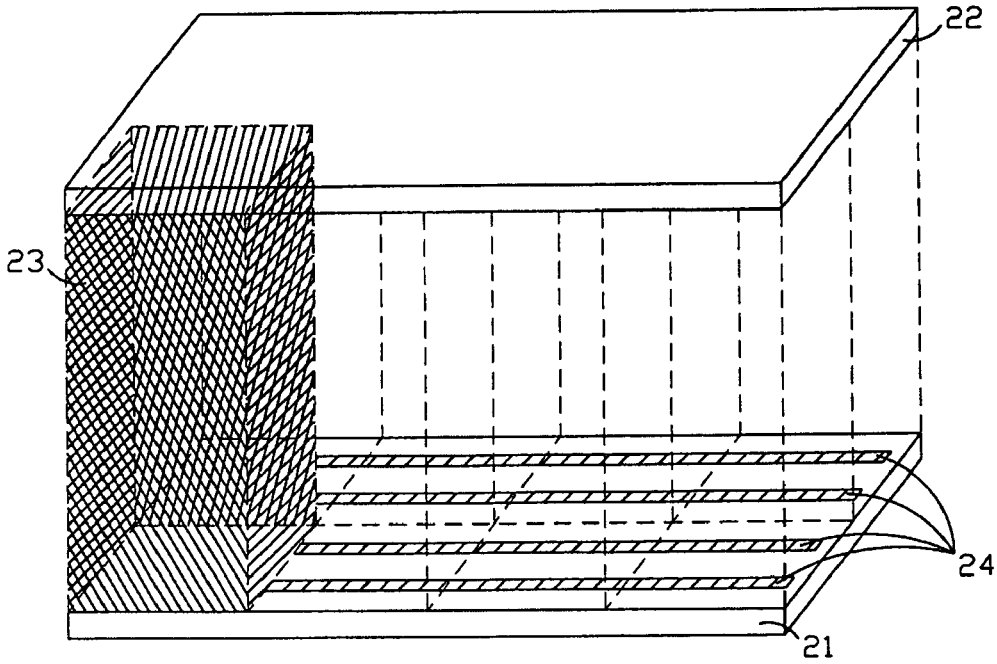
FIG. 2A to FIG. 2N are briefly illustrations of the essential structures of one preferred embodiment of the present invention; and FIG. 3A

One preferred embodiment of the present invention is a plasma display panel. As shown in FIG. 2A, the embodiment at least has first substrate 21, second substrate 22, numerous pixels 23 and numerous non-transparent display electrodes pairs 24.

In the embodiment, first substrate 21 and second substrate 22 are the conventional separated front plate and rear plate, and the pixels are located between first substrate 21 and second substrate 22. The embodiment never amends these portions of the PDP, all details of these portions are equal to the conventional PDP and then all figures omit these details. In contrast, the key points of the embodiment are focused on these non-transparent display electrodes pairs 24.

These non-transparent display electrodes pairs 24 are located on an opposing surface of first substrate 21 opposing to second substrate 22, each non-transparent display electrode pair 24 passing through numerous pixels 23, and each pixel 23 being passed by one non-transparent display electrodes pair 24. Herein, each non-transparent display electrode pair 24 has a first non-transparent display electrode 241 and separated second non-transparent display electrode 242. Besides, for each pixel 23, the shape of each non-transparent display electrode (241 or 242) and the distance between corresponding non-transparent display electrodes (241 and 242) is adjustable. Moreover, among different pixels 23, the shape of each non-transparent display electrode (241 or 242) and the distance between corresponding non-transparent display electrodes (241 and 242) could be the same or different.

Figure 1A:
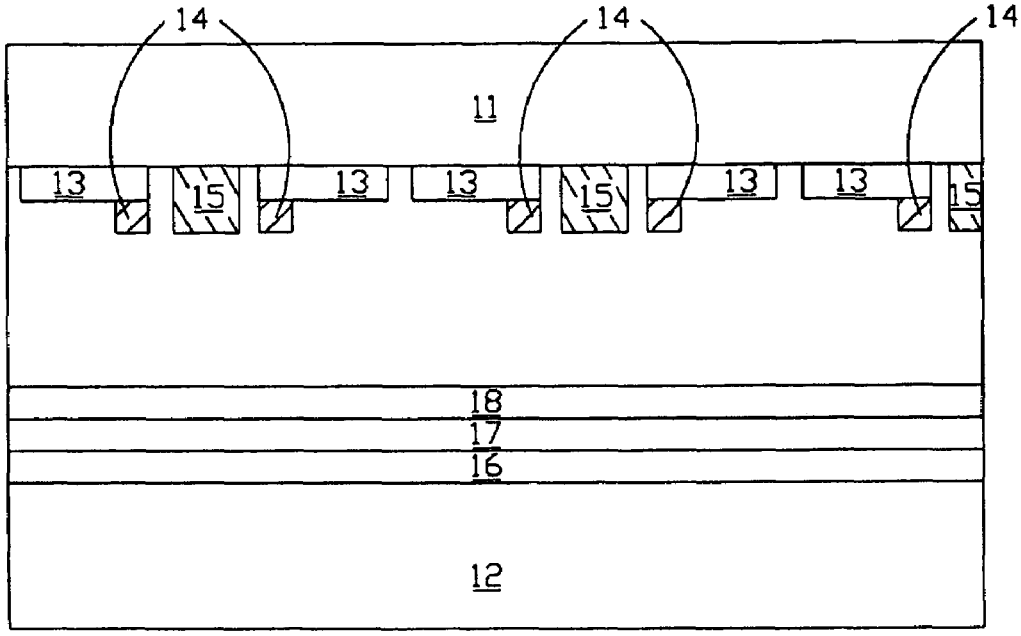
FIG.1A(Prior Art)
FIG. 1A and FIG. 1B separately shows the essential structure of the conventional plasma display panel and the essential structure of the electrodes of the conventional plasma display panel.
Figure 1B:
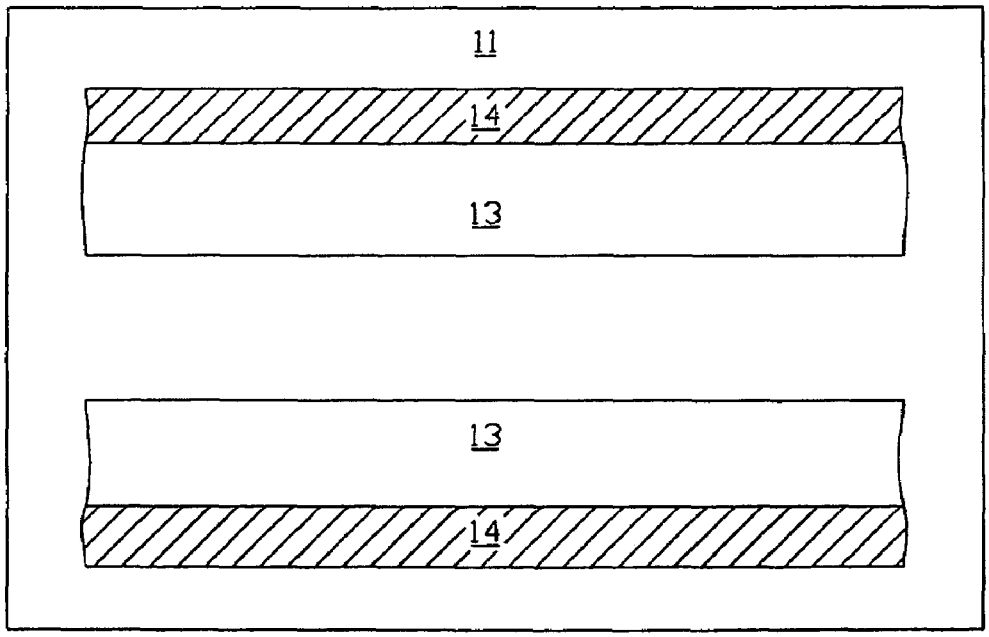
FIG.1B(Prior Art)

In other words, by comparing with the conventional PDP, such as FIG. 1A and FIG. 1B, one main character of the embodiment is that only non-transparent display electrodes pairs 24 are required but the transparent electrodes are negligible. In fact, after the shape and distance of each non-transparent display electrodes pair 24 are properly adjusted, any transparent electrode not contacted (such as electrically contacted) with the non-transparent display electrodes pairs is optional. In other words, if the data electrode is ignored, each pixel 23 could only have non-transparent electrode(s). Of course, each non-transparent electrode could be made of transparent conductive material and overlaid non-transparent conductive material. Herein, the embodiment only requires the existence of non-transparent display electrodes pairs 24, but never limits the material(s) and the forming method of the non-transparent display electrodes pairs 24.

Figure 2B:
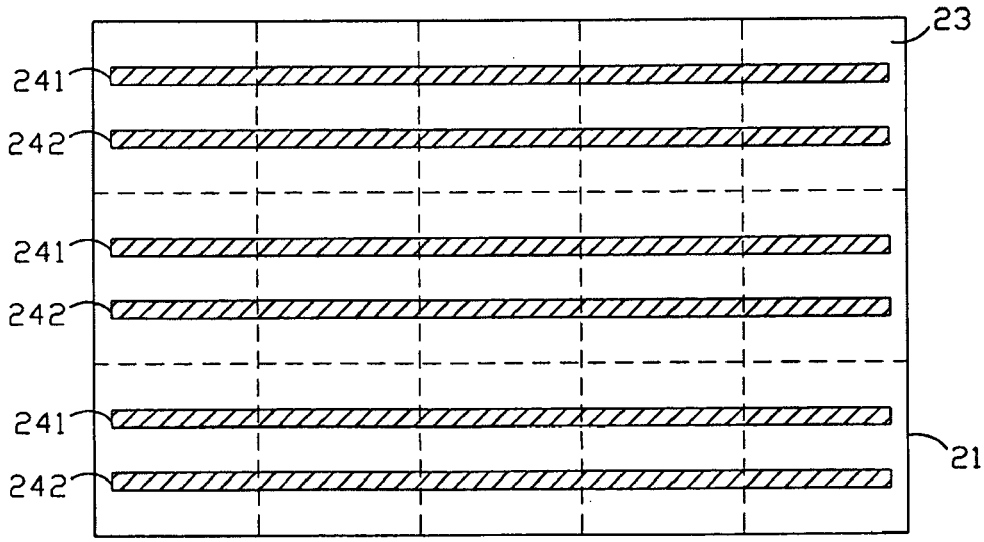

Further, the existence of non-transparent display electrodes pairs 24 would block the light and reduce the aperture ratio of PDP. Thus, as shown in FIG. 2B, for each pixel 23, the embodiment could further limit that the area occupied by corresponding transparent display electrodes pair 24 which is smaller than 25% of the total area for corresponding pixel 23.

Figure 2C:
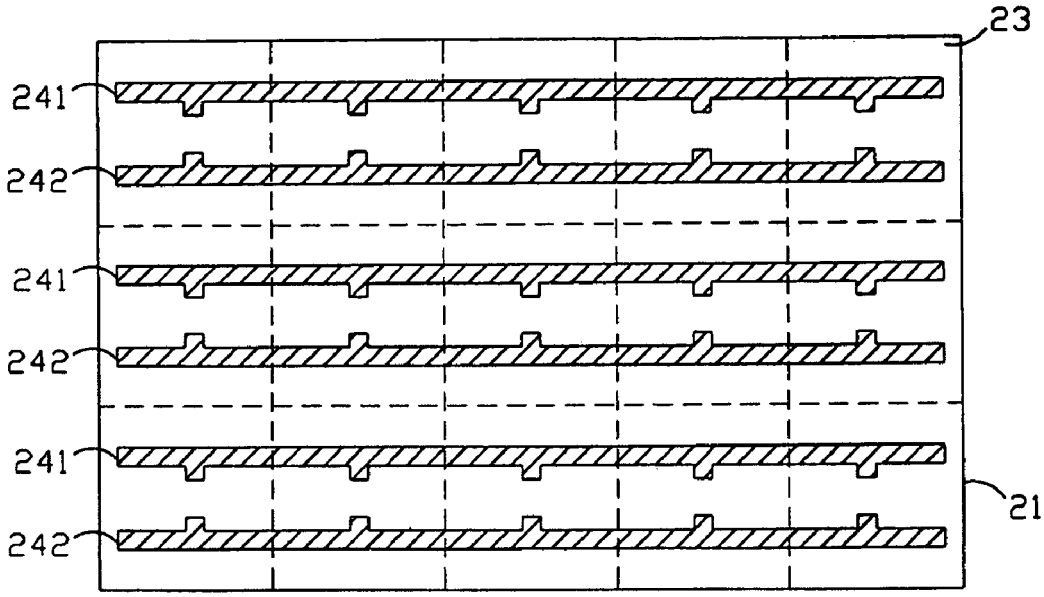
Figure 2D:
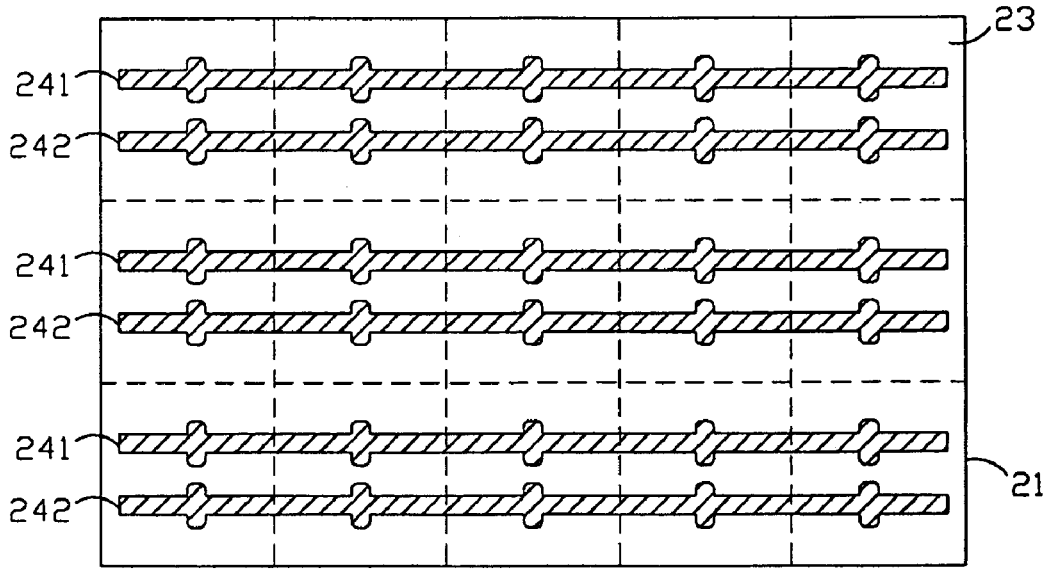

Furthermore, the distance between the first non-transparent electrode 241 and second and-transparent electrode 242 is an important factor of the details of the discharging process, such as the probability of discharging, the degree of the discharge process and the working voltage of the discharging process. Hence, for example, as shown in FIG. 2C and FIG. 2D, it is optional that the distance between the first non-transparent display electrode 241 and second non-transparent display electrode 242 is smaller than one-fifth of the length of a side of corresponding pixel 23 that crosses the non-transparent display electrodes pair 24. It is also optional that the distance between the first non-transparent display electrode 241 and second non-transparent display electrode 242 is smaller than one-tenth of the length of a side of corresponding pixel 23 that crosses non-transparent display electrodes pair 24. Surely, while the shape of non-transparent display electrode (241 and/or 242) is not a line shape, the distance between two display electrodes is the minimized distance between corresponding electrodes. Herein, a simple and possible limitation is that the distance between first non-transparent display electrode 241 and second non-transparent display electrode 242 is similar with or equal to the distance between two conventional transparent discharge electrodes. Besides, for each pixel 23, if two sides that cross non-transparent display electrodes pair 24, they will have a different length, it is optional to limit the distance simultaneously smaller than a specific ratio of one side and a specific ratio of another side, it also is optional to limits that the distance smaller than a specific ratio of one side.

Figure 2E:
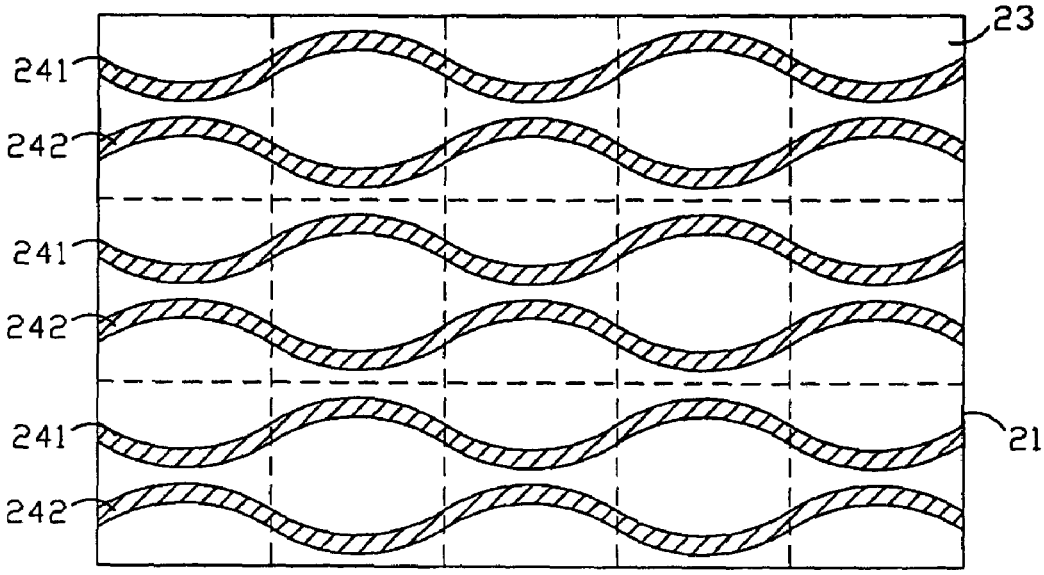

Besides, the point discharge phenomena teaches that a conductive pointed end is easier to discharge than a conductive plane. Therefore, as shown in FIG. 2E, in one pixel 23, the distance between first non-transparent display electrode 241 and second non-transparent display electrode 242 could be periodically varied along a side of pixel 23 that never crosses any non-transparent display electrode 241/242. Hence, the portion with a shorter distance is prior to excite the discharge process than other portions. Of course, to apply the point discharge phenomena, it only requires that the side (or edge) of at lease one non-transparent display electrode (241 or 242) is not a plane or a straight line, and it is not necessary to amend the sides of both non-transparent display electrodes (241 and 242) such that the distance is periodically varied. Therefore, for each pixel 23, it is optional that the side of first non-transparent display electrode 241 that faces the second non-transparent display electrode 242 has a curved shape, it is also optional that the side of the second non-transparent display electrode 242 that faces the first non-transparent display electrode 241 which has a curved shape.

Figure 2F:
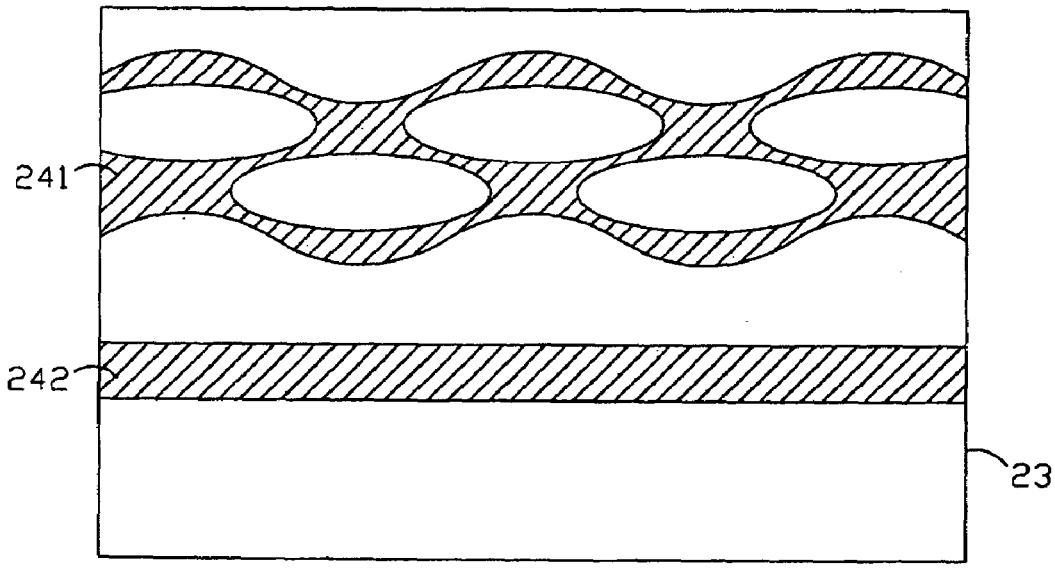
Figure 2G:
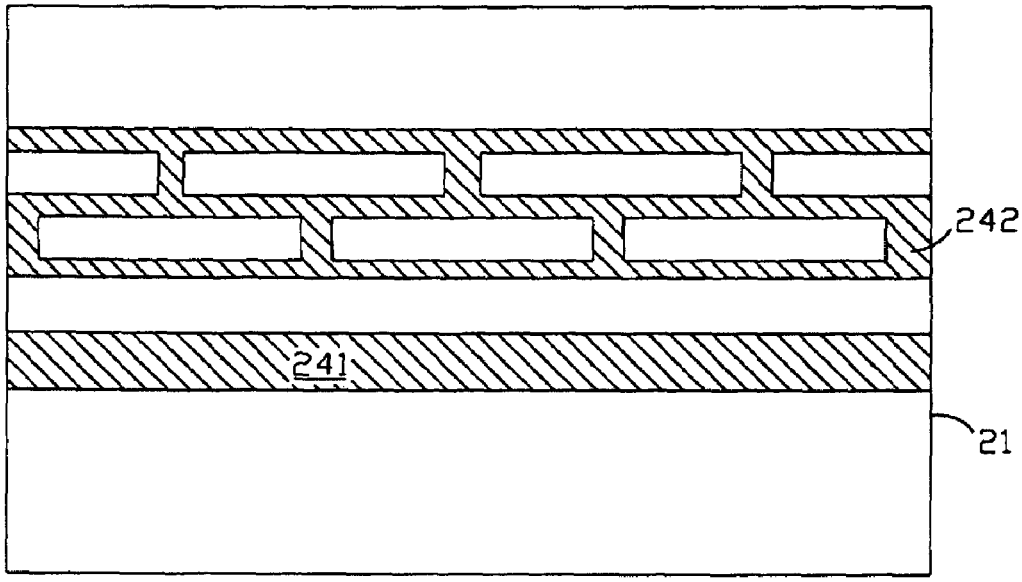

Furthermore, aims at the defects induced by errors of fabrication or problems of operations, the embodiment further uses the idea of bi-loops, or multi-loops, to overcome the defects induced by severed portion(s) of non-transparent display electrode. As shown in FIG. 2F and FIG. 2G, for each pixel 23, it is optional that each line parallel to a side of pixel 23 has two cross-points with first non-transparent display electrode 241 while the side is crossed with non-transparent display electrodes pair 24, it is also optional that each line parallel to a side of pixel 23 has two cross-points with second non-transparent display electrode 242 while the side is crossed with a non-transparent display electrodes pair 24. In other words, the embodiment could further limit at least one non-transparent display electrode which has a two dimensional shape. Surely, it is optional that each line parallel to a side of pixel 23 has two cross-points with first non-transparent display electrode 241 and two cross-points with second non-transparent display electrode 242 simultaneously while the side is crossed with a non-transparent display electrodes pair, it also is optional that each line parallel to a side of pixel 23 has two cross-points.

Clearly, the required two cross-points could be achieved by increasing the width of non-transparent display electrode (241 and/or 22) or by amending the shape of non-transparent display electrode (242 and/or 242) to have numerous transparent openings. Indeed, the embodiment never limits such details. However, because the aperture ratio is an important factor of PDP and the display result of PDP is strongly affected by non-transparent display electrodes pairs 24, it is better to use the shape with numerous transparent openings. The reason is that the same area of non-transparent display electrodes pair 24 is fragmentarily distributed over a larger area and then the probability that a non-transparent spot is visible and is decreased. Surely, the larger the transparent openings is, the larger the aperture ratio. For example, for each pixel 23, it is optional that the area of all transparent openings is not smaller than 75% of the area of pixel 23.

Figure 2H:
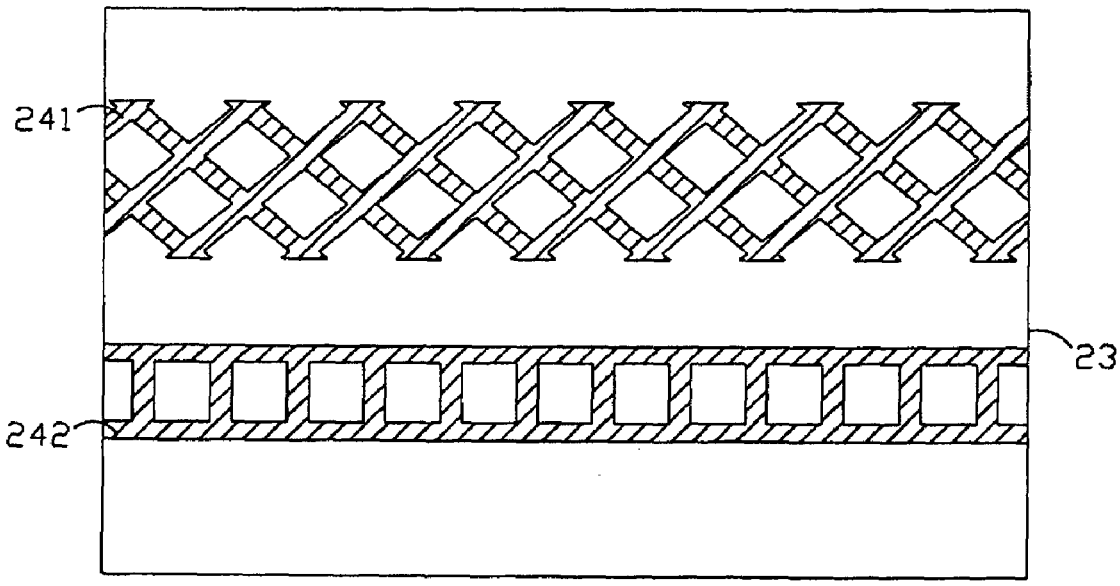
Figure 2I:
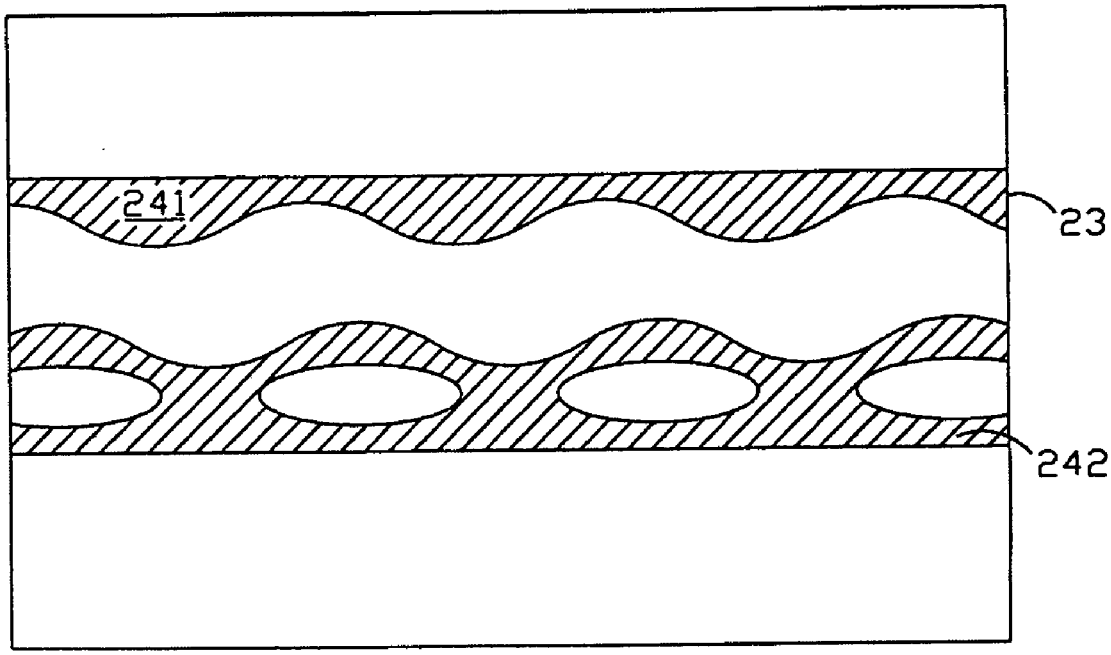
Figure 2J:
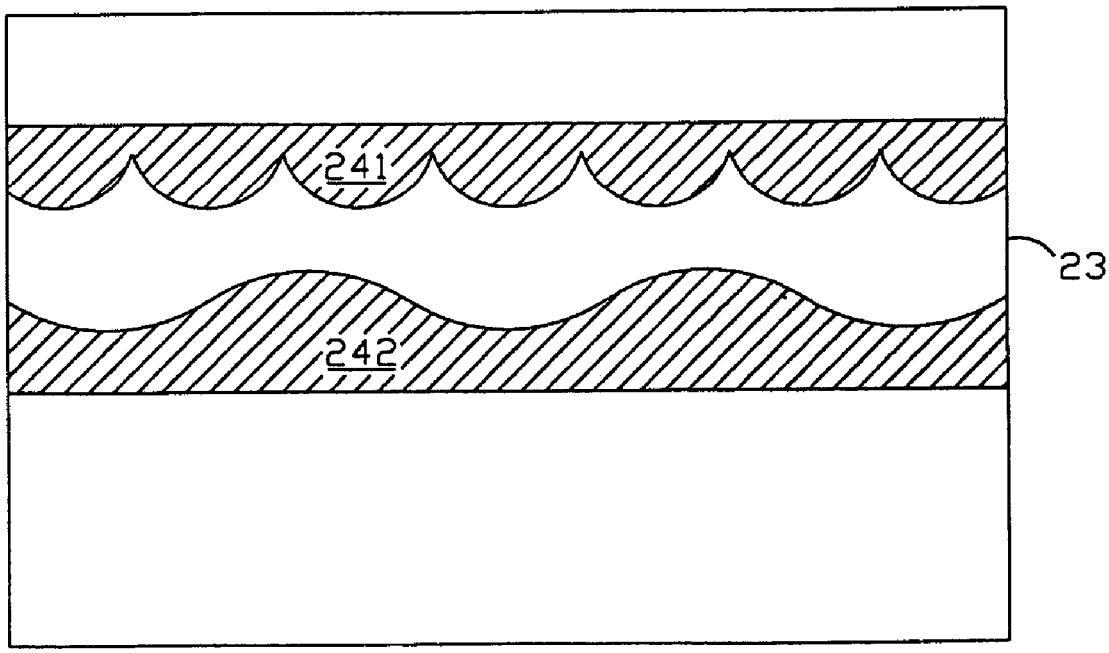
Figure 2K:
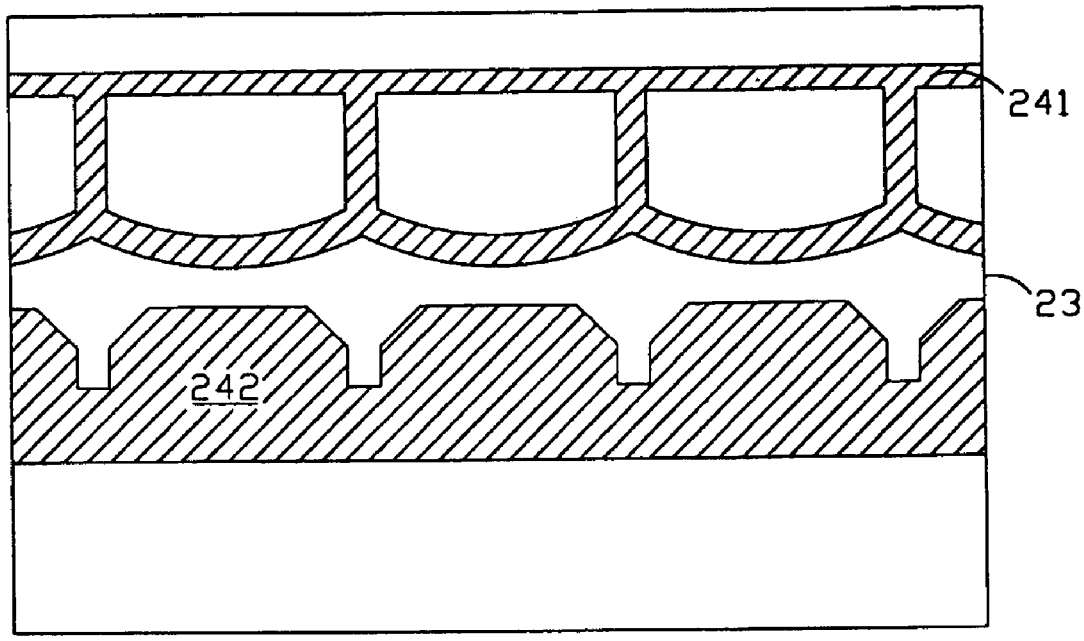
Figure 2L:
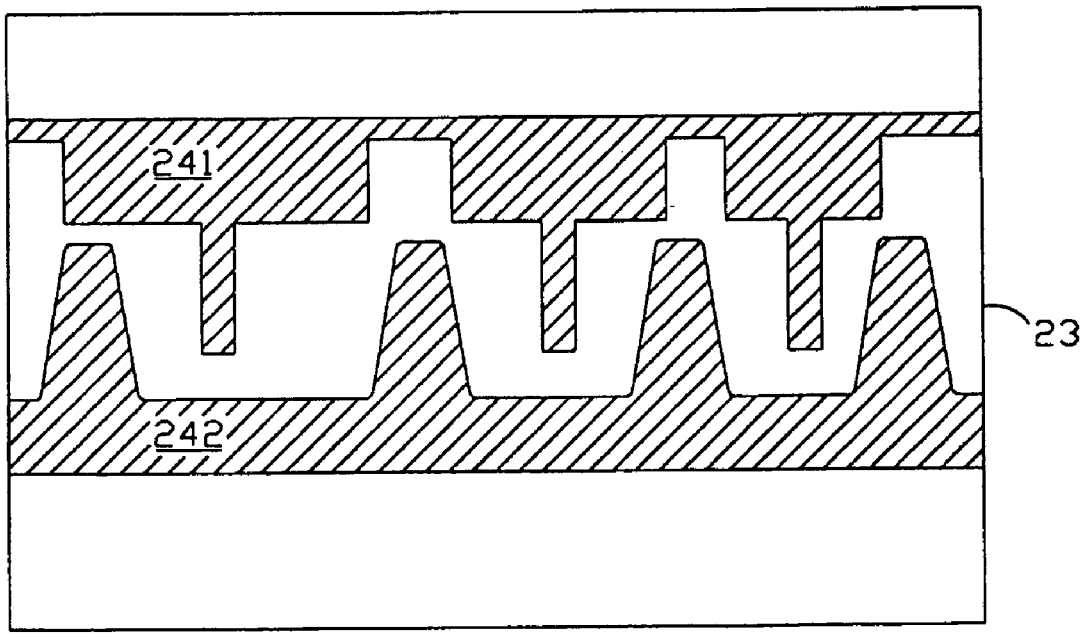

For instance, as shown in FIG. 2H and FIG. 2I, for each pixel 23, it is optional that first non-transparent display electrode 241 or second non-transparent display electrode 242 has the network shape, the railway track shape, the wave shape, the ladder shape, the chain shape or the wave shape with some transparent openings. For instance, as shown in FIG. 2J and FIG. 2L, for each pixel, it is optional that first non-transparent display electrode 241 or second non-transparent display electrode 242 has the shape that is a repeated combination of a specific unit, such as semi-circle shape, semi-ellipsoid shape, arc shape, polygon shape, convex shape and awl shape.

Figure 2M:
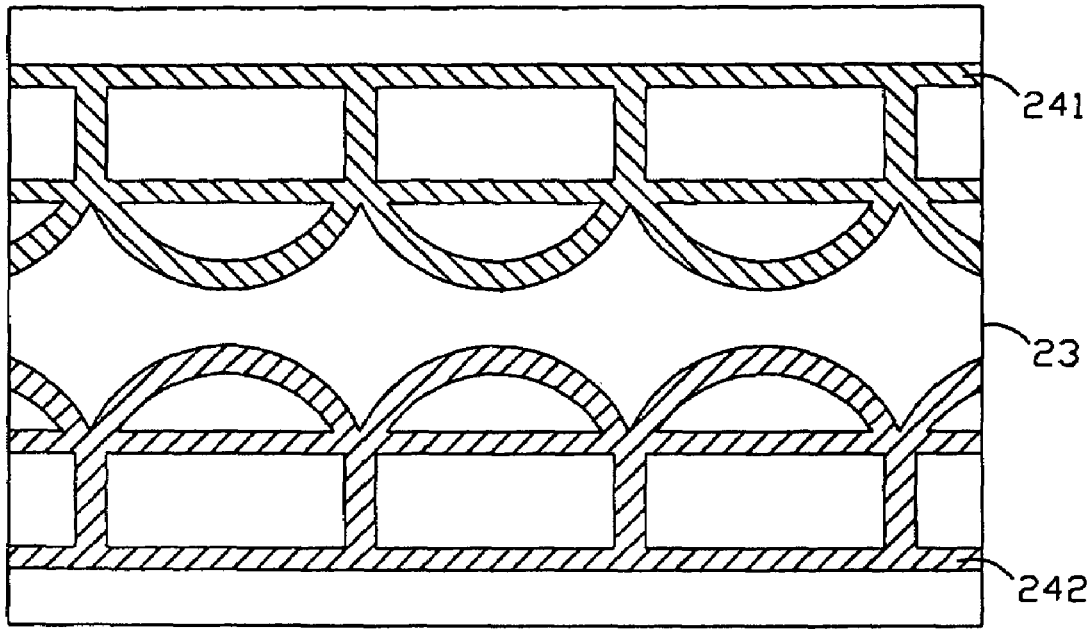
Figure 2N:
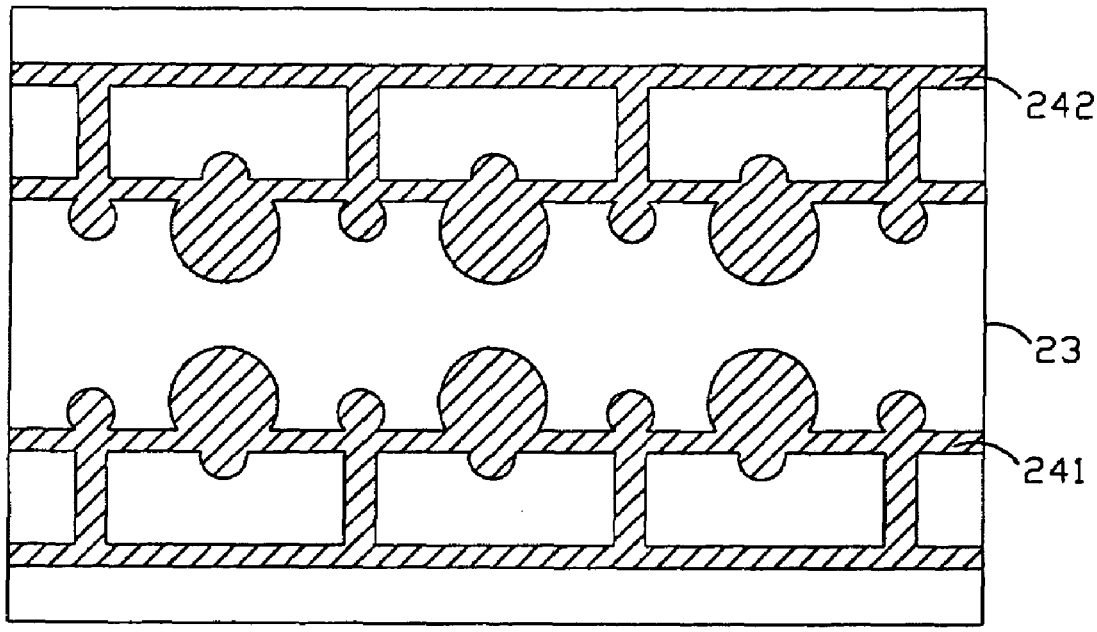

For instance, as shown in FIG. 2M and FIG. 2N, two optional shapes of non-transparent display electrodes pair 24 are provided. The two provided shapes are acquired from experimental data that utterly considers the idea of bi-loops (even multi-loops), the idea of point discharge and the requirement of a larger aperture ratio.

No matter how, for each pixel 23, the embodiment never limits the shape of each non-transparent display electrode (241, 242) and the distance between two non-transparent display electrode (241, 242). The embodiment also never limits the relation between two non-transparent display electrodes (241, 242) in each pixel 23. The essential limitation of the embodiment is that the application of non-transparent display electrodes pairs 24. An amendment of the embodiment is that each non-transparent display electrodes (241, 242) has a two dimensional shape, and a further amendment is that each non-transparent display electrodes (241, 242) has the previous shapes.

Figure 3A:
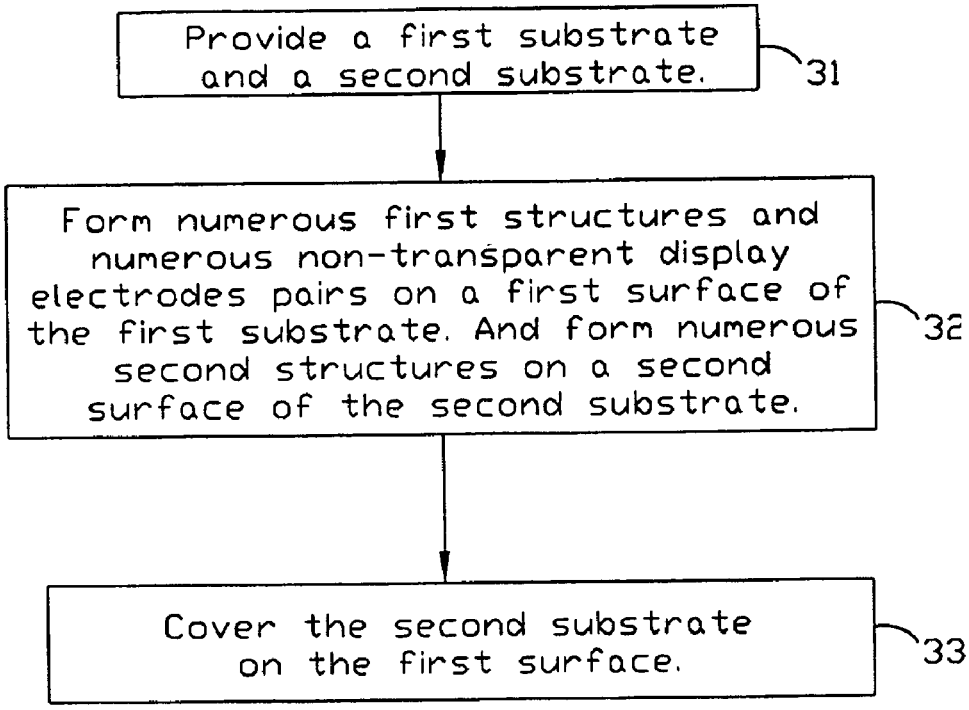
FIG. 3B shows the essential steps of another preferred embodiment of the present invention.

Another embodiment of the invention is a method of forming a plasma display panel. As shown in FIG. 3A, the embodiment has at least the following steps:

As shown in preparation block 31, provide a first substrate and a second substrate.

As shown in formation block 32, form numerous first structures and numerous non-transparent display electrodes pairs on a first surface of the first substrate. And form numerous second structures on a second surface of the second substrate. Herein, each non-transparent display electrodes pair pass through numerous first structures and each first structure is passed by one non-transparent display electrodes pair. Moreover, each non-transparent display electrode has a first non-transparent display electrode and a separated second non-transparent display electrode.

As shown in cover block 23, cover the second substrate on the first surface. Herein, numerous pixels are formed between the first substrate and the second substrate and made of the first structure, the second structures and the non-transparent display electrodes pairs.

Figure 3B:
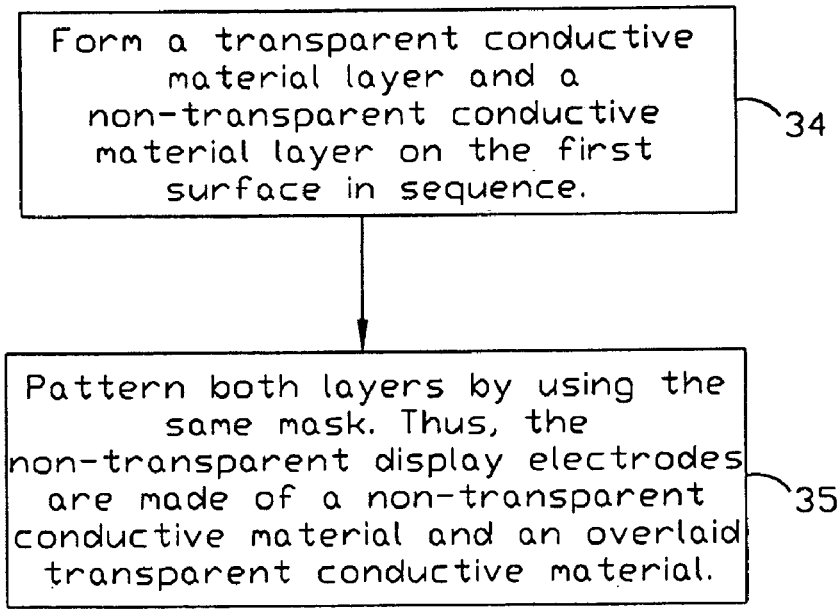

Of course, because the transparent conductive material is broadly used in the PDP fabrication, as shown in FIG. 3B, the non-transparent display electrodes could be made by the following steps:

As shown in material preparation block 34, form a transparent conductive material layer and a non-transparent conductive material layer on the first surface in sequence.

As shown in pattern formation block 35, pattern both layers by using the same mask. Thus, the non-transparent display electrodes are made of a non-transparent conductive material and an overlaid transparent conductive material.

Certainly, as discussed above, the shape and the distribution of the non-transparent display electrodes are changeable. Herein, only two basic amendments are emphasizes as following:

(a) To ensure the aperture ratio of PDP, for each pixel, the area occupied by the non-transparent display electrode pair is smaller than one-tenth of the area of the pixel.

(b) To ensure the normal operation of the discharge process, for each pixel, the distance between the first non-transparent display electrode and the second non-transparent display electrode is smaller than one-tenth of the length of a side of the pixel that crosses the non-transparent display electrodes pair.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel, comprising:

a first substrate;

a second substrate, which is opposite to said first substrate but separated from each other;

a plurality of pixels, which are located between said first substrate and said second substrate; and a plurality of non-transparent display electrodes pairs, which said non-transparent display electrodes pairs are located on a surface of said first substrate opposite to said second substrate, each said non-transparent display electrodes pair comprises a first non-transparent display electrode and a second non-transparent display electrode separated from each other, in each of said pixels, the area of said non-transparent display electrodes pair in said pixel is smaller than 25% of the total area of said pixel, a distance between said first non-transparent electrodes and said second non-transparent electrodes is shorter than a specific ratio of one side of said pixel that crosses pair of said non-transparent display electrodes pair and said distance between said first non-transparent electrodes and said second non-transparent electrodes is periodically varied along a side of said pixel without crossing any said non-transparent display electrode, and at least one of said first and said second non-transparent display electrodes has a plurality of transparent openings.

2. The plasma display panel of claim 1, wherein each said pixel has no transparent electrode contacted with said pair of non-transparent display electrodes.

3. The plasma display panel of claim 1, wherein said distance between said first and second non-transparent display electrodes is shorter than one-fifth of the length of a side of said pixel that crosses said pair of non-transparent display electrodes in each of said pixels.

4. The plasma display panel of claim 1, wherein said distance between said first and said second non-transparent display electrodes is shorter than one-tenth of the length of a side of said pixel that crosses pair of said non-transparent display electrodes in each of said pixels.

5. The plasma display panel of claim 1, wherein a line parallel to a side of said pixel has two cross-points with said first non-transparent display electrode while said side is crossed with said pair of non-transparent display electrodes in each of said pixels.

6. The plasma display panel of claim 1, wherein a line parallel to a side of said pixel has two cross-points with said second non-transparent display electrode while said side is crossed with said non-transparent display electrodes pair in each of said pixels.

7. The plasma display panel of claim 1, wherein the side of said first non-transparent display electrode facing to said second non-transparent display electrode has a curved shape in each of said pixels.

8. The plasma display panel of claim 1, wherein the side of said second non-transparent display electrode facing to said first non-transparent display electrode has a curved shape in each of said pixels.

9. The plasma display panel of claim 1, wherein at least one of said first and said second non-transparent display electrodes has a kind of shape selected from the group consisting of network shape, railway track shape, wave shape, ladder shape, chain shape and wave shape with some transparent openings in each of said pixels.

10. The plasma display panel of claim 1, wherein at least one of said first and said second non-transparent display electrodes has a kind of shape with repeated combination of a specific unit in each of said pixels.

11. The plasma display panel of claim 10, wherein the shape of said specific unit is selected from the group consisting of: semi-circle shape, semi-ellipsoid shape, arc shape, polygon shape, convex shape and awl shape in each of said pixels.

12. The plasma display panel of claim 1, wherein at least one of said non-transparent display electrodes is an overlaid combination of a non-transparent material and a transparent material in each of said pixels.

13. A plasma display panel, comprising:

a first substrate;

a second substrate, which is opposite to said first substrate but separated from each other;

a plurality of pixels, which are located between said first substrate and said second substrate; and a plurality of non-transparent display electrodes pairs, which said non-transparent display electrodes pairs are located on a surface of said first substrate opposite to said second substrate, each said non-transparent display electrodes pair comprises a first non-transparent display electrode and a second non-transparent display electrode separated from each other, in each pixel, a distance between said first non-transparent electrodes and said second non-transparent electrodes is shorter than one-fifth of the length of one side of said pixel that crosses said non-transparent display electrodes pair and is periodically varied along a side of said pixel without crossing any said non-transparent display electrode, and at least one of said first and said second non-transparent display electrodes has a plurality of transparent openings.

14. The plasma display panel of claim 13, wherein each pixel has no transparent electrode contacted with said pair of non-transparent display electrodes.

15. The plasma display panel of claim 13, wherein, the area of said non-transparent display electrodes pair in said pixel is smaller than 25% of the total area of said pixel in each pixel.

16. The plasma display panel of claim 13, wherein said distance between said first and said second non-transparent display electrodes is shorter than one-tenth of the length of a side of said pixel that crosses pair of said non-transparent display electrodes in each pixel.

17. The plasma display panel of claim 13, wherein a line parallel to a side of said pixel has two cross-points with said first non-transparent display electrode while said side is crossed with pair of said non-transparent display electrodes in each pixel.

18. The plasma display panel of claim 13, wherein a line parallel to a side of said pixel has two cross-points with said second non-transparent display electrode while said side is crossed with said non-transparent display electrodes pair.

19. The plasma display panel of claim 13, wherein the side of said first non-transparent display electrode facing to said second non-transparent display electrode has a curved shape in each pixel.

20. The plasma display panel of claim 13, wherein the side of said second non-transparent display electrode facing to said first non-transparent display electrode has a curved shape in each pixel.

21. The plasma display panel of claim 13, wherein at least one of said first and said second non-transparent display electrodes has a kind of shape selected from the group consisting of network shape, railway track shape, wave shape, ladder shape, chain shape and wave shape with some transparent openings.

22. The plasma display panel of claim 13, wherein at least one of said first and said second non-transparent display electrodes has the a kind of shape with repeated combination of a specific unit.

23. The plasma display panel of claim 22, wherein the shape of said specific unit is selected from the group consisting of: semi-circle shape, semi-ellipsoid shape, arc shape, polygon shape, convex shape and awl shape.

24. The plasma display panel of claim 13, wherein, in each of said pixels, at least one of said non-transparent display electrodes is an overlaid combination of a non-transparent material and a transparent material.

* * * * *